US006877636B2

(12) United States Patent
Speckhart et al.

(10) Patent No.: US 6,877,636 B2
(45) Date of Patent: Apr. 12, 2005

(54) METHOD OF DISCHARGING AN AEROSOLIZED FLUID

(75) Inventors: Frank Speckhart, Knoxville, TN (US); Dan S. Pitsenberger, Fort Wayne, IN (US)

(73) Assignee: Dekko Technologies, Inc., North Webster, IN (US)

( * ) Notice: Subject to any disclaimer, the term of this patent is extended or adjusted under 35 U.S.C. 154(b) by 0 days.

(21) Appl. No.: 10/779,886

(22) Filed: Feb. 17, 2004

(65) Prior Publication Data

US 2005/0023287 A1 Feb. 3, 2005

Related U.S. Application Data

(60) Provisional application No. 60/448,025, filed on Feb. 18, 2003.

(51) Int. Cl.[7] ..... B67B 7/00

(52) U.S. Cl. ..... 222/1; 222/52; 222/61; 222/645; 222/649

(58) Field of Search ..... 222/1, 52, 645, 222/61, 63, 504, 646–649, 644, 641, 402.13, 402.1; 251/129.05; 239/67–70

(56) References Cited

U.S. PATENT DOCUMENTS 3,632,020 A * 1/1972 Nixon et al. ..... 222/646
3,666,144 A * 5/1972 Winder ..... 222/646
3,677,441 A * 7/1972 Nixon et al. ..... 222/63
4,184,612 A * 1/1980 Freyre ..... 222/639
4,658,985 A * 4/1987 Madsen et al. ..... 222/1
5,029,729 A * 7/1991 Madsen et al. ..... 222/1
5,297,988 A * 3/1994 Nishino et al. ..... 454/75
5,772,074 A * 6/1998 Dial et al. ..... 222/1
6,216,925 B1 * 4/2001 Garon ..... 222/645
6,267,297 B1 * 7/2001 Contadini et al. ..... 239/1
6,276,574 B1 * 8/2001 Smrt ..... 222/646

* cited by examiner

*Primary Examiner*—Frederick C. Nicolas
(74) *Attorney, Agent, or Firm*—Taylor & Aust. P.C.

(57) ABSTRACT

A method of discharging an aerosolized fluid from an aerosol can to an ambient environment, which includes a solenoid valve of an aerosol release device fluidly coupled with a discharge valve on the aerosol can; a duration of a first release period of the aerosolized fluid from the aerosol can being determined the solenoid valve being actuated, using an electronic controller to thereby release the aerosolized fluid to the ambient environment for the duration of the first release period; a duration of a second release period of the aerosolized fluid from the aerosol can being determined; where the duration of the second release period being randomly varied to avoid user habituation of the aerosolized fluid; and the solenoid valve being actuated using the electronic controller to thereby release the aerosolized fluid to the ambient environment for the duration of the second release period.

12 Claims, 3 Drawing Sheets

METHOD OF DISCHARGING AN AEROSOLIZED FLUID

CROSS REFERENCE TO RELATED APPLICATIONS

This is a non-provisional application based upon U.S. provisional patent application Ser. No. 60/448,025, entitled "AEROSOL RELEASE DEVICE ", filed Feb. 18, 2003.

BACKGROUND OF THE INVENTION

1. Field of the Invention

The present invention relates to aerosolized chemical delivery systems, and, more particularly, to methods of discharging an aerosolized fluid from such aerosol delivery systems.

2. Description of the Related Art

Aerosol delivery systems can be used to deliver a liquid chemical to the ambient environment. For example, an aerosol can may contain a fragrance, insecticide, anti-mold compound or an anti-mildew compound which is continuously or periodically discharged to the ambient environment. A common type of chemical delivery system includes electrical prongs which are plugged into acceptable outlet within a building. Power is provided to a heater circuit which evaporates the liquid chemical to the ambient environment.

A problem with a chemical delivery system as described above is that pressure within the aerosol can decreases over time, resulting in a lesser amount of the liquid chemical being discharged to the ambient environment as the pressure decreases. It is known to address the problem of a decreasing pressure in the aerosol can by increasing the duration of the delivery pulse from the aerosol can to the ambient environment. See, for example, FIG. 3 and U.S. Pat. No. 5,029,729 (Madsen, et al.). Madsen, et al. '729 also discloses that it is possible to use a constant release period and increase the frequency of release over time to offset the decreasing pressure (FIG. 4). Madsen, et al. '729 does not address the possibility of increasing both the release duration as well as the cycle frequency for the purpose of addressing the decrease in pressure within the aerosol can.

Another problem is that regardless of whether release periods are adjusted to accommodate the decrease in pressure within the aerosol can, the user may become habituated to the smell of the liquid chemical in the case of a fragrance which is discharged to the ambient environment. This clearly is not desirable as the user is unable to detect the pleasant aroma given off by the liquid fragrance.

What is needed in the art is an aerosol delivery system, which is operated in such a manner that problems of both decreased pressure within the aerosol can as well as user habituation are accommodated.

SUMMARY OF THE INVENTION

The present invention provides a method of actuating an aerosol delivery system, which avoids user habituation and automatically adjusts for a decreasing pressure over time in the aerosol can.

The invention comprises, in one form thereof, a method of discharging an aerosolized fluid from an aerosol can to an ambient environment, including the steps of: fluidly coupling a solenoid valve of an aerosol release device with a discharge valve on the aerosol can; determining a duration of a first release period of the aerosolized fluid from the aerosol can; actuating the solenoid valve using an electronic controller to thereby release the aerosolized fluid to the ambient environment for the duration of the first release period; determining a duration of a second release period of the aerosolized fluid from the aerosol can, the duration of the second release period being randomly varied to avoid user habituation of the aerosolized fluid; and actuating the solenoid valve using the electronic controller to thereby release the aerosolized fluid to the ambient environment for the duration of the second release period.

The invention comprises, in another form thereof, a method of discharging an aerosolized fluid from an aerosol can to an ambient environment, including the steps of: fluidly coupling a solenoid valve of an aerosol release device with a discharge valve on the aerosol can; determining a duration of a first release period of the aerosolized fluid from the aerosol can; actuating the solenoid valve using an electronic controller to thereby release the aerosolized fluid to the ambient environment for the duration of the first release period; determining a decreasing pressure profile over time of the aerosolized fluid within the aerosol can; determining a duration of a second release period of the aerosolized fluid from the aerosol can, dependent upon the decreasing pressure profile, the duration of the second release period being increased in both frequency and duration over time relative to the first release period; and actuating the solenoid valve using the electronic controller to thereby release the aerosolized fluid to the ambient environment for the duration of the second release period.

An advantage of the present invention is that user habituation to the fluid chemical delivered to the ambient environment is avoided.

A further advantage is that both the period between adjacent release periods and/or the duration of the release period can be randomly varied to avoid user habituation.

Another advantage is that delivery of the fluid chemical is automatically adjusted to accommodate a decreasing pressure over time in the aerosol can.

Yet another advantage is that an additional amount of the fluid chemical may be manually dispersed to the ambient environment by depressing a manual switch.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
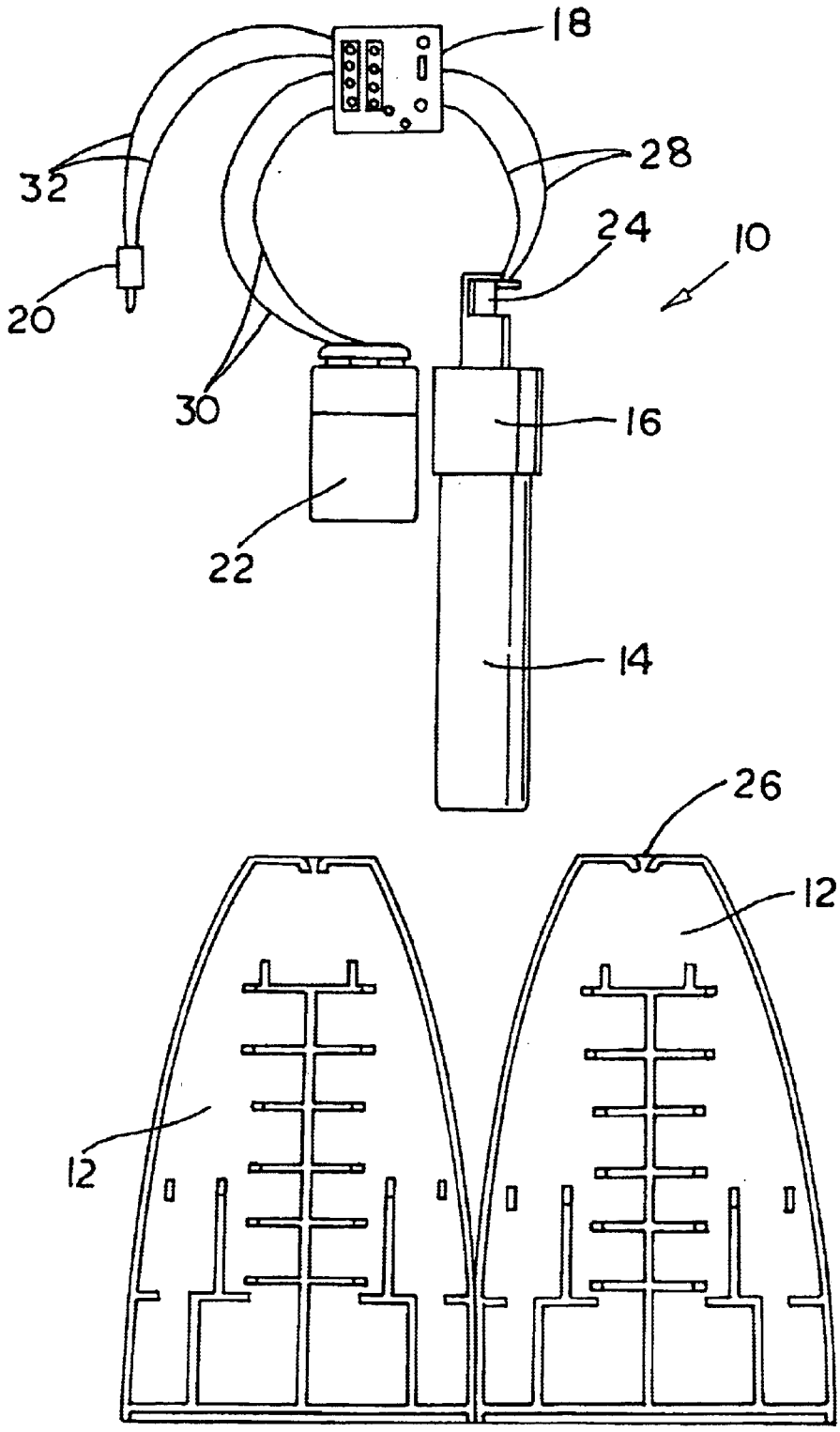
FIG. 1 is an exploded view of an embodiment of an aerosol delivery system, which may be used for carrying out the method of the present invention.
Figure 2:
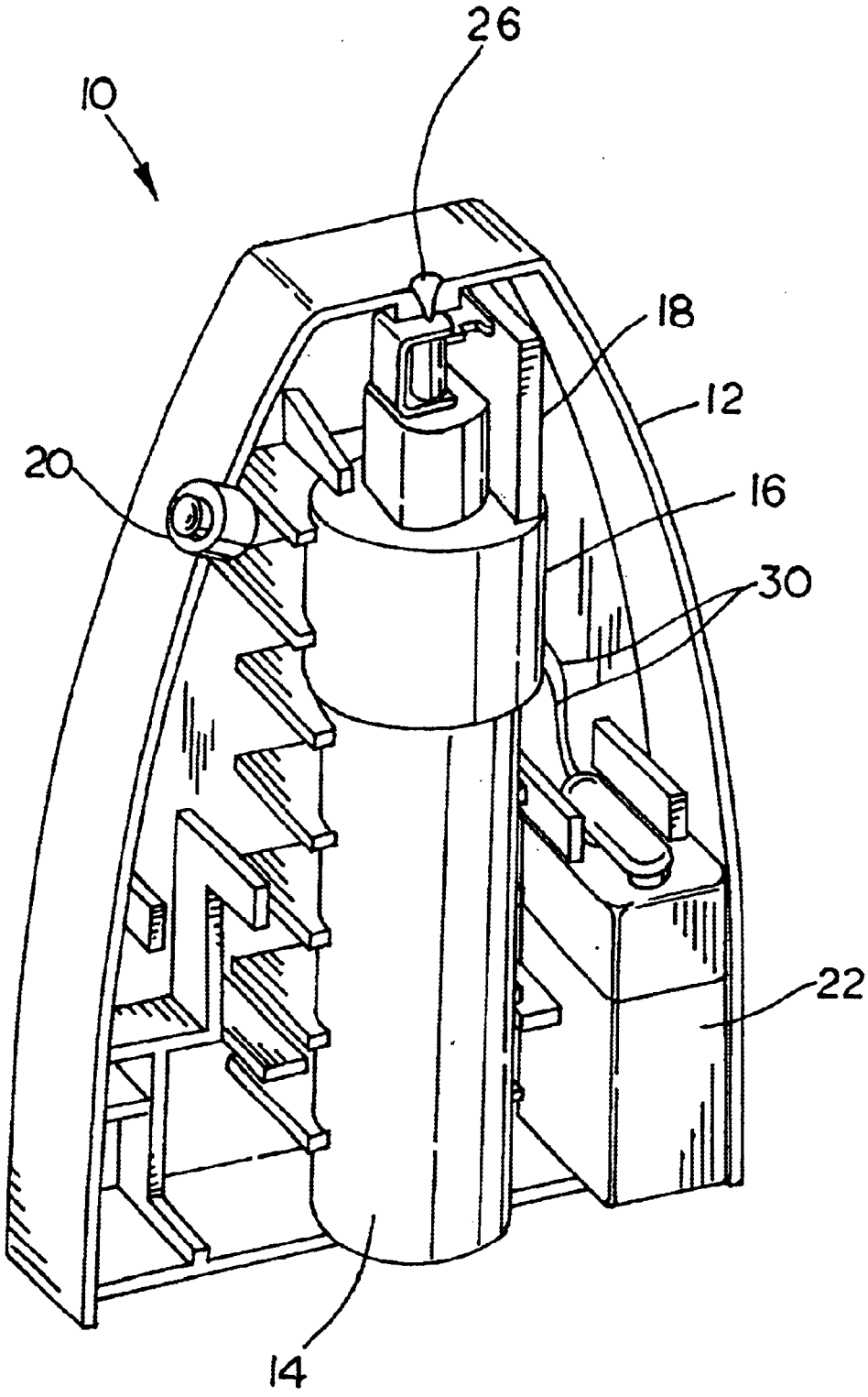
FIG. 2 is an assembled view of the aerosol delivery system of FIG. 1, with part of the housing removed.
Figure 3:
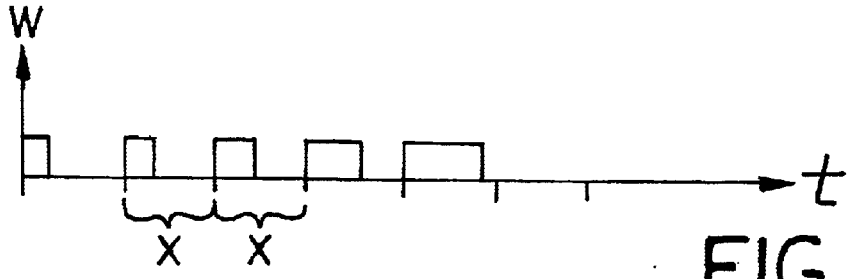
FIG. 3 PRIOR ART
FIG. 3 is a graphical illustration of a prior art method of actuating an aerosol delivery system.
Figure 4:
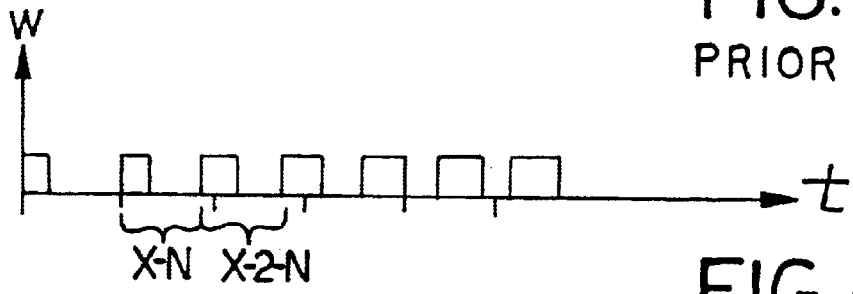
FIG. 4 PRIOR ART
FIG. 4 is a graphical illustration of another prior art method of actuating an aerosol delivery system.

Referring now to the drawings, and more particularly to FIGS. 1 and 2, there is shown an embodiment of an aerosol delivery system 10 which may be used for carrying out the method of the present invention. Aerosol delivery system 10 generally includes a housing 12, aerosol can 14, solenoid valve 16, electronic controller 18, manual switch 20 and battery 22.

Aerosol can 14 contains an aerosolized fluid therein which is selectively discharged to the ambient environment. In the embodiment shown, aerosol can 14 contains a fragrance therein, but may also contain an insecticide, an anti-mold compound, and/or other suitable liquid chemicals to be discharged to the ambient environment.

An aerosol release device is coupled with the discharge end of aerosol can 14. The aerosol release device generally includes solenoid valve 16, electronic controller 18, manual switch 20 and battery 22.

Solenoid valve 16 is coupled with the discharge end of aerosol can 14, and maintains the discharge valve (not specifically shown) of aerosol can 14 in a depressed position. Since the discharge valve of aerosol can 14 is maintained in the open or depressed position, fluid discharge to the ambient environment is entirely controlled by operation of solenoid valve 16. Solenoid valve 16 may be of conventional design, and includes a discharge outlet 24, which is positioned in alignment with a discharge orifice 26 formed in housing 12 when aerosol can 14 is positioned within housing 12.

Electronic controller 18 is electrically coupled with solenoid valve 16 via electrical wires 28. Electronic controller 18 includes suitable electrical components, such as a processor, resistors, etc. Electronic controller 18 is electrically coupled with battery 22 via electrical wires 30. In the embodiment shown, battery 22 is a conventional nine-volt battery. Manual switch 20 is electrically coupled with electronic controller 18 via electrical wires 32, and upon actuation causes manual actuation of solenoid valve 16 through electrical wires 28.

Figure 5:
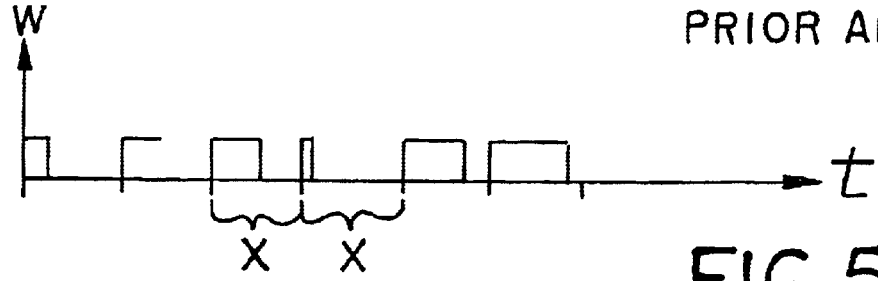
FIG. 5 is a graphical illustration of an embodiment of the method of the present invention for actuating an aerosol delivery system such as shown in FIGS. 1 and 2.
Figure 6:
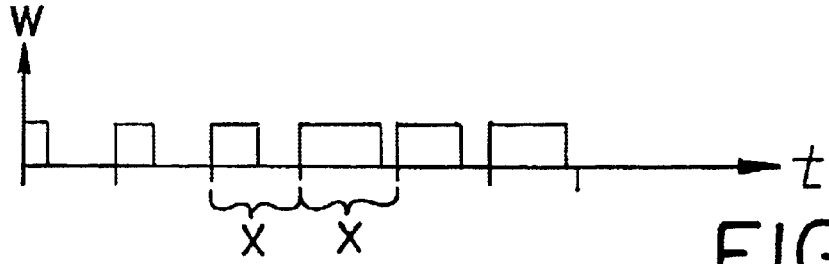
FIG. 6 is a graphical illustration of another embodiment of the method of the present invention for actuating an aerosol delivery system.
Figure 7:
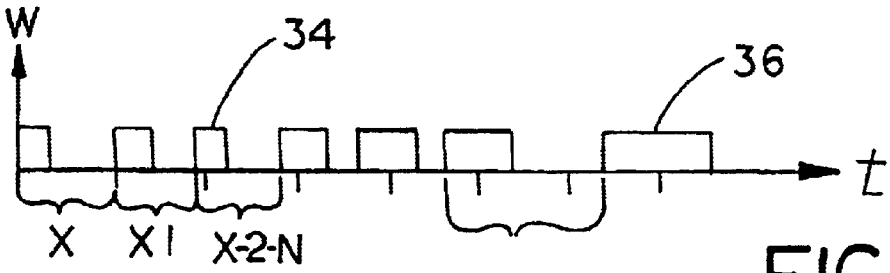
FIG. 7 is a graphical illustration of yet another embodiment of the method of the present invention for actuating an aerosol delivery system.

Referring now to FIGS. 5–7, an embodiment of the method of the present invention for discharging an aerosolized fluid from aerosol can 14 to the ambient environment using, e.g., aerosol delivery system 10 will be described in further detail. As will be appreciated, the pressure within aerosol can 14 decreases over time, dependent upon the amount of fluid which is discharged from aerosol can 14. As the pressure decreases, the volume of the liquid which is discharged to the ambient environment over a period of time increases. In the embodiment shown in FIG. 5, the duration during which the solenoid valve is held open during a release period is generally increased in a stepwise linear fashion. For the purposes of illustration, it may be observed in FIG. 5 that except for the duration beginning at the fourth release period, the duration for the other release periods increase generally linearly for each successive release period.

Of course, it will also be appreciated that the duration for a release period may be kept at a constant volume for a number or block of release periods, with adjacent blocks of release periods being stepwise linearly increased. For example, it is possible to have the first three release periods of a given duration, the next three release periods of a longer duration, the next three release periods of a still longer duration, etc.

With the foregoing general chemical release scheme as illustrated in FIG. 5, solenoid valve 16 is actuated for successively longer periods of time to accommodate the decrease in pressure in aerosol can 14. However, this stepwise linear increase in the duration of the release period neglects the tendency of a user to become habituated from the liquid chemical which is discharged into the ambient environment. To avoid user habituation, the method of the present invention interjects a randomness to the discharge of the liquid chemical to the ambient environment. In the embodiment shown in FIG. 5, the randomly generated pulse width or duration of the fourth release period (the first release beginning at time=0) is not in sync with the duration of the preceding and succeeding release periods. That is, it would be expected that the duration of the randomly generated fourth release period would be longer than that of the third release period and shorter than that of the fifth release period. However, as can be observed, the duration of the fourth release period is much shorter than any of the other release periods. The randomness of the duration of the fourth release period is intended to overcome the problem of user habituation.

As may also be observed in FIG. 5, each release period begins at a constant frequency or period X relative to preceeding and succeeding release periods. In addition to generating a random duration for a particular release period, it is also possible to randomize the frequency of the release periods to avoid user habituation.

FIG. 6 illustrates another embodiment of a method of the present invention for avoiding user habituation. Particularly, a method of discharging an aerosolized fluid is shown in FIG. 6 at a constant period cycle for each release period, beginning each release period at a period X from an adjacent release period. Also similar to FIG. 5, the method shown in FIG. 6 has a stepwise linear increase for the duration of each release period over time. However, with the fourth release period (beginning at the third hash mark), the duration of the release period is randomized and is not in the expected sequence relative to the other release periods. That is, the duration of the fourth release period is much longer than it should be in a stepwise linear increased manner for the purpose of avoiding user habituation.

FIG. 7 illustrates yet another embodiment of a method of discharging an aerosolized fluid from an aerosol can. In the embodiment shown in FIG. 7, the overall scheme to compensate for reduction in pressure is not to increase the duration of each release period, but rather to increase the frequency (i.e. decrease the period size) for succeeding release periods over time. To that end, the cycle period is decreased in a stepwise linear fashion an amount for each succeeding release period. For the period of time shown in FIG. 7, two randomized release periods 34 and 36 having randomized release durations are illustrated. Moreover, the period cycles associated with each randomized release period 34 and 36 are likewise randomized. For example, the period cycle preceeding release period 34 has the reduced period cycle X–N. However, the period cycle has been randomized to the duration $X_1$. Similarly, the period cycle preceeding release period 36 has been randomized to cycle period $X_2$.

As a further possibility of randomization which may be used for the purpose of avoiding user habituation, it is assumed in the above example that randomized release periods are a set integer number away from each other. For example, the randomized release period 36 is four release periods away from the randomized release period 34. However, it is also possible for the purpose of avoiding user habituation to randomize the integer number between adjacent randomized release periods. That is, the spacing between two adjacent randomized release periods could be four cycle periods and the spacing between another two randomized release periods could be six cycle periods.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of discharging an aerosolized fluid from an aerosol can to an ambient environment, comprising the steps of:

fluidly coupling a solenoid valve of an aerosol release device with a discharge valve on said aerosol can;

determining a duration of a first release period of the aerosolized fluid from the aerosol can;

actuating said solenoid valve using an electronic controller to thereby release the aerosolized fluid to the ambient environment for said duration of said first release period;

determining a duration of a second release period of the aerosolized fluid from the aerosol can, said duration of said second release period being randomly varied to avoid user habituation of the aerosolized fluid; and actuating said solenoid valve using said electronic controller to thereby release the aerosolized fluid to the ambient environment for said duration of said second release period.

2. The method of discharging an aerosolized fluid of claim 1, including the steps of:

determining a duration of a third release period of the aerosolized fluid from the aerosol can after said second release period;

determining a duration of a fourth release period of the aerosolized fluid from the aerosol can, said duration of said fourth release period being randomly varied to avoid user habituation of the aerosolized fluid;

determining a period from a beginning of said fourth release period to a beginning of a previous release period, said period associated with said fourth release period being randomly varied; and actuating said solenoid valve using said electronic controller to thereby release the aerosolized fluid to the ambient environment for said duration of said fourth release period.

3. The method of discharging an aerosolized fluid of claim 1, including the steps of:

determining a decreasing pressure profile of the aerosolized fluid within the aerosol can, dependent upon a number of said actuations of said solenoid valve;

determining a duration of a third release period of the aerosolized fluid from the aerosol can, said third release period being increased relative to said first release period, dependent upon said decreasing pressure profile.

4. The method of discharging an aerosolized fluid of claim 3, including the step of increasing a frequency of at least one of said second release period and said third release period over time, dependent upon said decreasing pressure profile.

5. The method of discharging an aerosolized fluid of claim 1, wherein said duration of said second release period is randomly varied relative to said first release period.

6. The method of discharging an aerosolized fluid of claim 1, wherein the aerosolized fluid comprises one of a fragrance, insecticide, anti-mold compound and anti-mildew compound.

7. The method of discharging an aerosolized fluid of claim 1, including the step of manually discharging aerosolized fluid from the aerosol can using a manual switch.

8. The method of discharging an aerosolized fluid of claim 1, including the step of powering said solenoid valve and said electronic controller with a battery.

9. A method of discharging an aerosolized fluid from an aerosol can to an ambient environment, comprising the steps of:

fluidly coupling a solenoid valve of an aerosol release device with a discharge valve on said aerosol can;

determining a duration of a first release period of the aerosolized fluid from the aerosol can;

actuating said solenoid valve using an electronic controller to thereby release the aerosolized fluid to the ambient environment for said duration of said first release period;

determining a decreasing pressure profile over time of the aerosolized fluid within the aerosol can;

determining a duration of a second release period of the aerosolized fluid from the aerosol can, dependent upon said decreasing pressure profile, said duration of said second release period being increased in both frequency and duration over time relative to said first release period; and actuating said solenoid valve using said electronic controller to thereby release the aerosolized fluid to the ambient environment for said duration of said second release period.

10. The method of discharging an aerosolized fluid of claim 9, wherein said determined decreasing pressure profile of the aerosolized fluid within the aerosol can is dependent upon a number of said actuations of said solenoid valve.

11. The method of discharging an aerosolized fluid of claim 9, wherein the aerosolized fluid comprises one of a fragrance, insecticide, anti-mold compound and anti-mildew compound.

12. The method of discharging an aerosolized fluid of claim 9, including the step of manually discharging aerosolized fluid from the aerosol can using a manual switch.

* * * * *

UNITED STATES PATENT AND TRADEMARK OFFICE

CERTIFICATE OF CORRECTION

PATENT NO. : 6,877,636 B2
DATED : April 12, 2005
INVENTOR(S) : Speckhart et al.

It is certified that error appears in the above-identified patent and that said Letters Patent is hereby corrected as shown below:

Title page,
Item [56], References Cited, U.S. PATENT DOCUMENTS, add:

| | | | | |
|---|---|---|---|---|
| -- 3,589,563 | * | 6/1971 | Carragan et al. | 222/70 |
| 3,627,176 | * | 12/1971 | Sailors | 222/70 |
| 3,666,144 | * | 5/1972 | Winder | 222/70 |
| 3,974,941 | * | 8/1976 | Mettler | 222/70 |
| 4,006,844 | * | 2/1977 | Corris | 222/70 |
| 4,077,542 | * | 3/1978 | Petterson | 222/70 |
| 4,415,797 | * | 11/1983 | Choustoulakis | 219/273 |
| 4,658,985 | * | 4/1987 | Madsen et al. | 222/1 |
| 5,012,961 | * | 5/1991 | Madsen et al. | 222/643 |
| 5,029,729 | * | 7/1991 | Madsen et al. | 222/1 |
| 6,216,925 | * | 4/2001 | Garon | 222/645 --; |

Insert -- FOREIGN PATENT DOCUMENTS
GB 2 153 680 A 8/1985 --; and
Item [57], ABSTRACT,
Line 6, between "determined" and "the" insert -- and --.

Signed and Sealed this

Eighteenth Day of April, 2006

JON W. DUDAS
*Director of the United States Patent and Trademark Office*